US005167596A

United States Patent [19]

Ferber

[11] Patent Number: 5,167,596

[45] Date of Patent: Dec. 1, 1992

[54] HAND-HELD EXERCISER

[76] Inventor: Dennis Ferber, 1844 N. El Camino Real, Suite 47, San Clemente, Calif. 92672

[21] Appl. No.: 844,735

[22] Filed: Mar. 2, 1992

[51] Int. Cl.[5] ..... A63B 23/14

[52] U.S. Cl. ..... 482/46; 482/45; 482/114; 482/118

[58] Field of Search ..... 482/114, 115, 116, 117, 482/118, 49, 79, 80, 55, 44, 45, 46

[56] References Cited

U.S. PATENT DOCUMENTS

| | | | |
|---|---|---|---|
| 2,668,055 | 2/1954 | Sharp et al. | 482/46 |
| 3,211,453 | 10/1965 | Williams | 482/46 |
| 4,557,479 | 5/1980 | Guibert | 482/44 |
| 4,643,417 | 2/1987 | Niemau | 482/46 |
| 4,702,474 | 10/1987 | Guibert | 272/122 |
| 4,779,866 | 10/1988 | Marshall et al. | 482/116 |
| 4,869,492 | 9/1989 | Joutras | 482/118 |
| 4,943,047 | 7/1990 | Noble | 272/68 |
| 5,046,727 | 9/1991 | Wilkinson et al. | 482/118 |

*Primary Examiner*—Robert Bahr
*Assistant Examiner*—J. Donnelly

[57] ABSTRACT

A portable, articulated, hand-held exercising device comprising a pair of elongated tubular handles pivotally connected to the respective ends of an elongated tubular cross-bar for three-axis rotation and having an adjustable torque/force characteristics. The cross-bar may be telescopically adjustable. Each handle may simulate the grip of a handled sports appliance such as a tennis racquet, golf club, and the like. The exerciser serves in general to condition the wrist, arms, chest, torso, back, legs and shoulders of the user. The handles are rotatable about their respective longitudinal axes, and they are hinged to the cross-bar at the respective longitudinal axis, and they are hinged to the cross-bar at the respective ends thereof. Each handle, when held by the user, may be turned back and forth pivotally above the corresponding end of the cross-bar with adjustable force adjustment characteristics, and each handle may be rotated about as longitudinal axis with adjustable torque adjustment characteristics. In addition, the handles may be rotated in opposite directions about the longitudinal axis of the cross-bar assembly. The handles may be replaced with pedals for exercising the upper and lower leg muscles and ankles of the user.

14 Claims, 11 Drawing Sheets

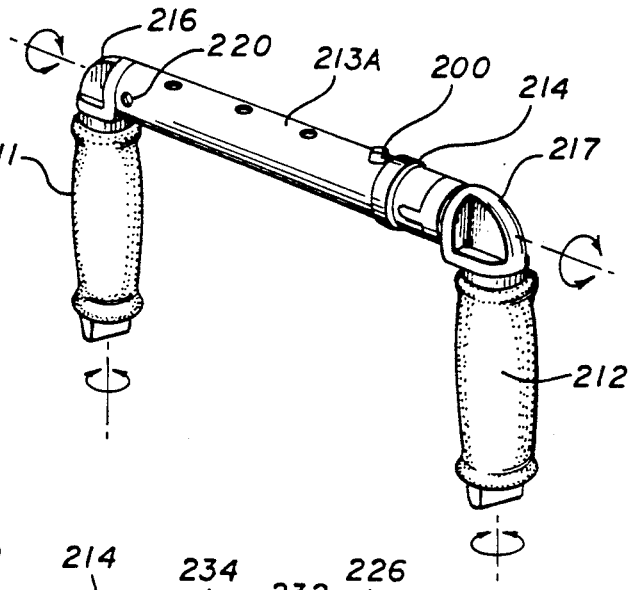
FIG. 8
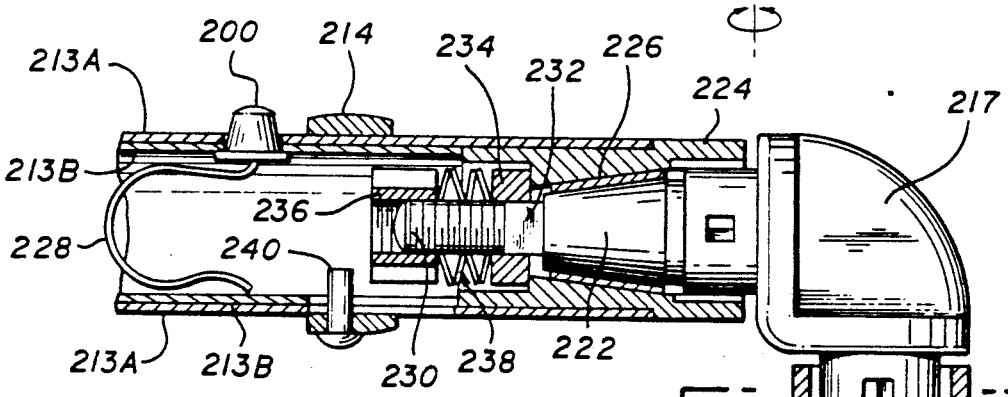
FIG. 9
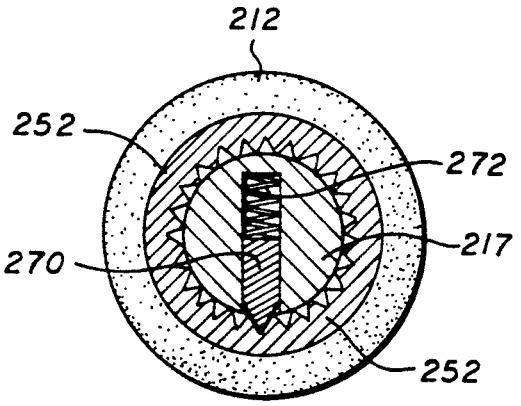
FIG. 10
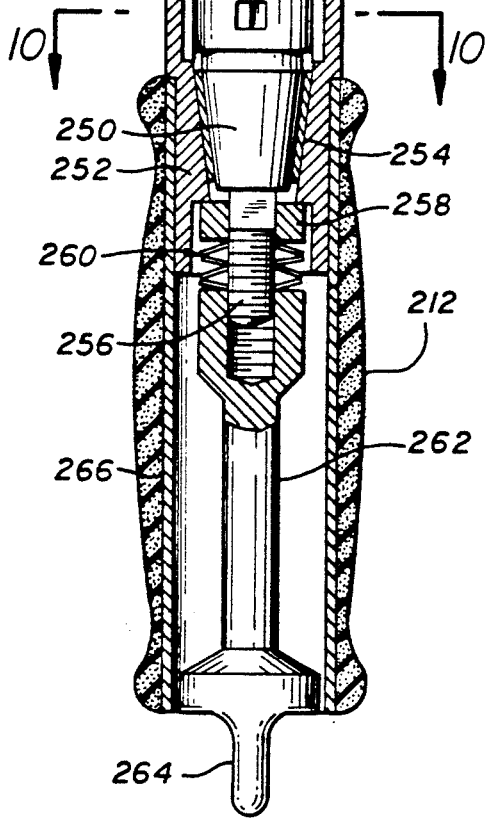

HAND-HELD EXERCISER

BACKGROUND OF THE INVENTION

The invention relates to a manual exerciser suitable for fitness, athletic, therapeutic and general exercising purposes. The invention relates more particularly to an articulated exerciser which when held in the hands of a user is capable of being manipulated to undergo both simple and complex motions. This serves to bring into play and develop the muscles of the muscular system associated with the user's shoulders, arms, wrists, chest, torso, back and legs.

SUMMARY OF THE INVENTION

The invention provides a portable, articulated, hand-held exerciser which comprises left-and right-hand handles connected by a cross-bar, preferably of a telescopic, adjustable construction. The exerciser is constructed to provide three-axis rotation of the handles, and it includes means for providing an adjustable torque/force in each handle and in the cross-bar. Each handle may simulate the grip of a sports appliance, such as a tennis racket, golf club, and the like. The exerciser serves to exercise the wrists, arms, shoulders, chest, torso, back and legs of the user. The handles are rotatable about their longitudinal axes, and they are hinged to the cross-bar. Each handle when held by the user, may be turned back and forth pivotally about the corresponding end of the cross-bar with adjustable force adjustment, and each handle may be rotated about its longitudinal axis with adjustable torque adjustment. In addition, the handles are rotatable about the longitudinal axis of the cross-bar with adjustable torque adjustment.

The exerciser of the invention is capable of executing both simple and complex motions to develop muscle strength and endurance with respect to the muscles of the muscular system associated with the wrists, arms, chest, shoulder, torso, back and legs of the users.

By way of the example, the cross-bar may be constructed to have an 8" length in one embodiment of the invention for exercising the wrists and, forearms of the user; and to have a 20" length in a second embodiment to exercise the chest, shoulder, torso, arms and back muscles. In addition, the handle bars may be replaced with pedals for exercising the upper and lower leg muscles and ankles of the user. If so desired, the cross-bar may be made extensible to a variety of selected lengths which makes it possible to use a single unit to exercise different parts of the same muscle group.

It is accordingly, an objective of the present invention to provide a small, readily portable, hand-held exercising device which is reasonably simple to operate, and which is fully effective in achieving its intended purpose.

It should be pointed out that any motion of the exerciser of the invention may be duplicated in reverse to exercise opposing muscles. This action is not possible in most known exercisers). This exercisers because of lack of controlled resistance in both directions.

BRIEF DESCRIPTION OF THE DRAWINGS

FIG. 8 is a perspective view of an exerciser representing a third embodiment of the invention;

FIG. 9 is a side view of a portion of the exerciser of FIG. 8, partly in section to reveal certain internal components of the cross-bar and one of the handles of the exerciser;

FIG. 10 is a section taken along the line 10—10 of FIG. 9;

DETAILED DESCRIPTION OF THE ILLUSTRATED EMBODIMENTS

Figure 1:
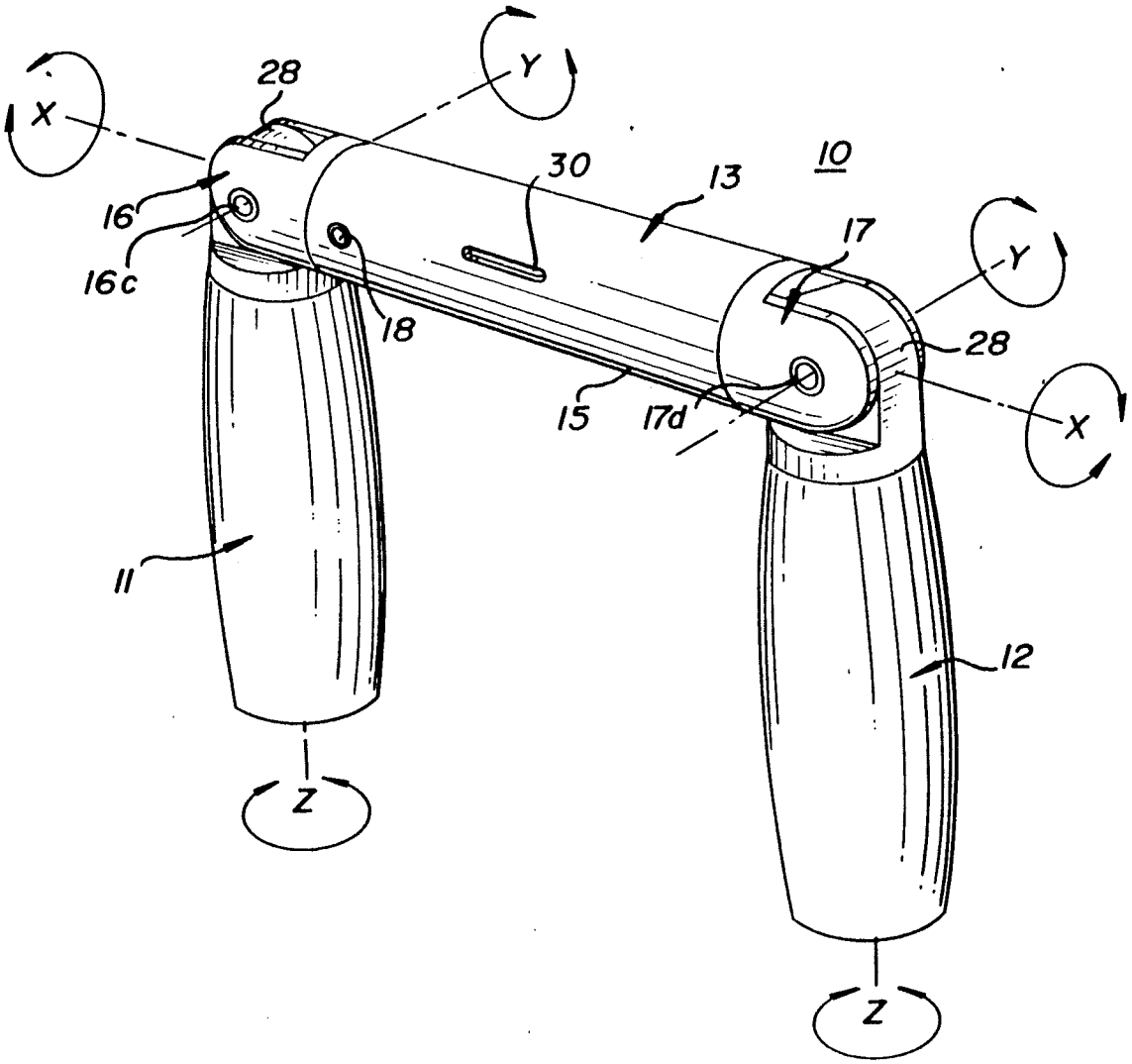
FIG. 1 is a perspective view of an exerciser representing one embodiment of the invention.

The exerciser 10 of the invention, as shown in FIG. 1, comprises a hollow tubular cross bar 13, and two tubular elongated handles 11, 12 mounted on the respective ends of the cross-bar. The handles 11 and 12 are rotatable about their respective longitudinal axes (Z-1), and they are also rotatable about respective pivotal axes (Y-1) at the ends of the cross-bar. In addition, the handles are rotatable about the longitudinal axes X—X of the cross-bar.

Figure 2:
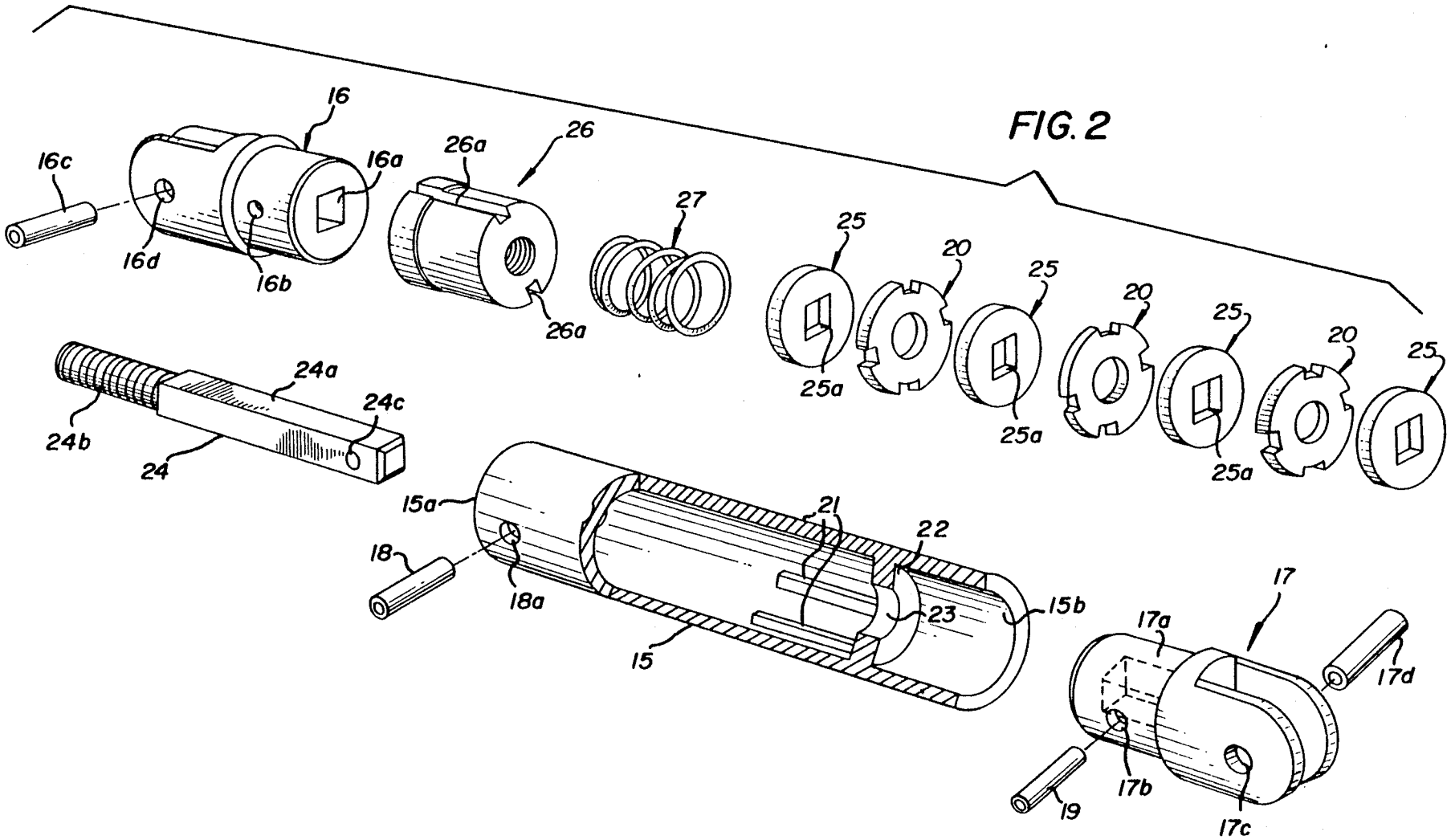
FIG. 2 is an exploded perspective view of a cross-bar assembly representing one of the components of the exerciser of FIG. 1, and also showing the internal components of the cross-bar assembly.
Figure 3:
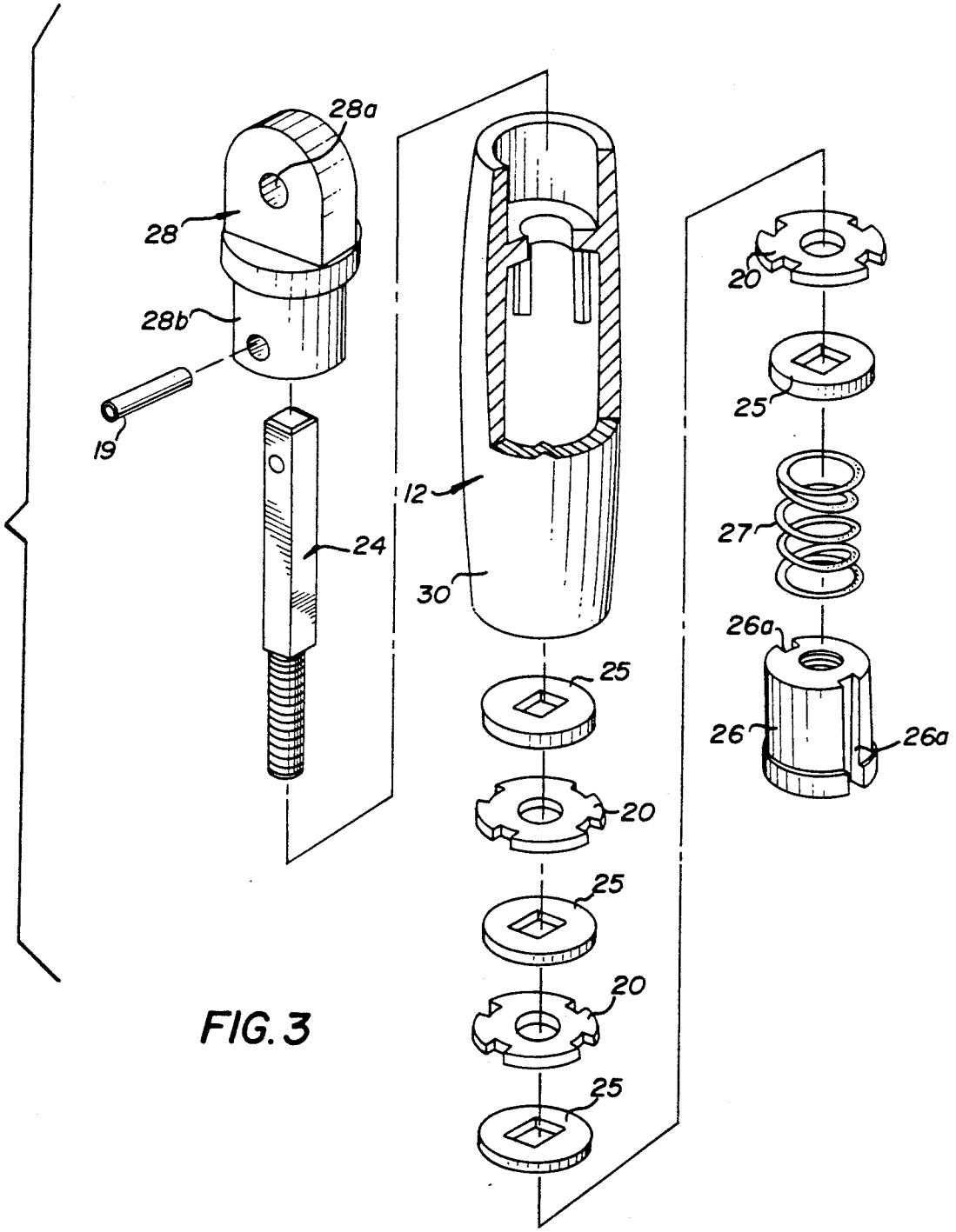
FIG. 3 is an exploded perspective view of one of two like handle components of the exerciser of FIGURE 1, and also showing the internal components of the handle.
Figures 4, 4A:
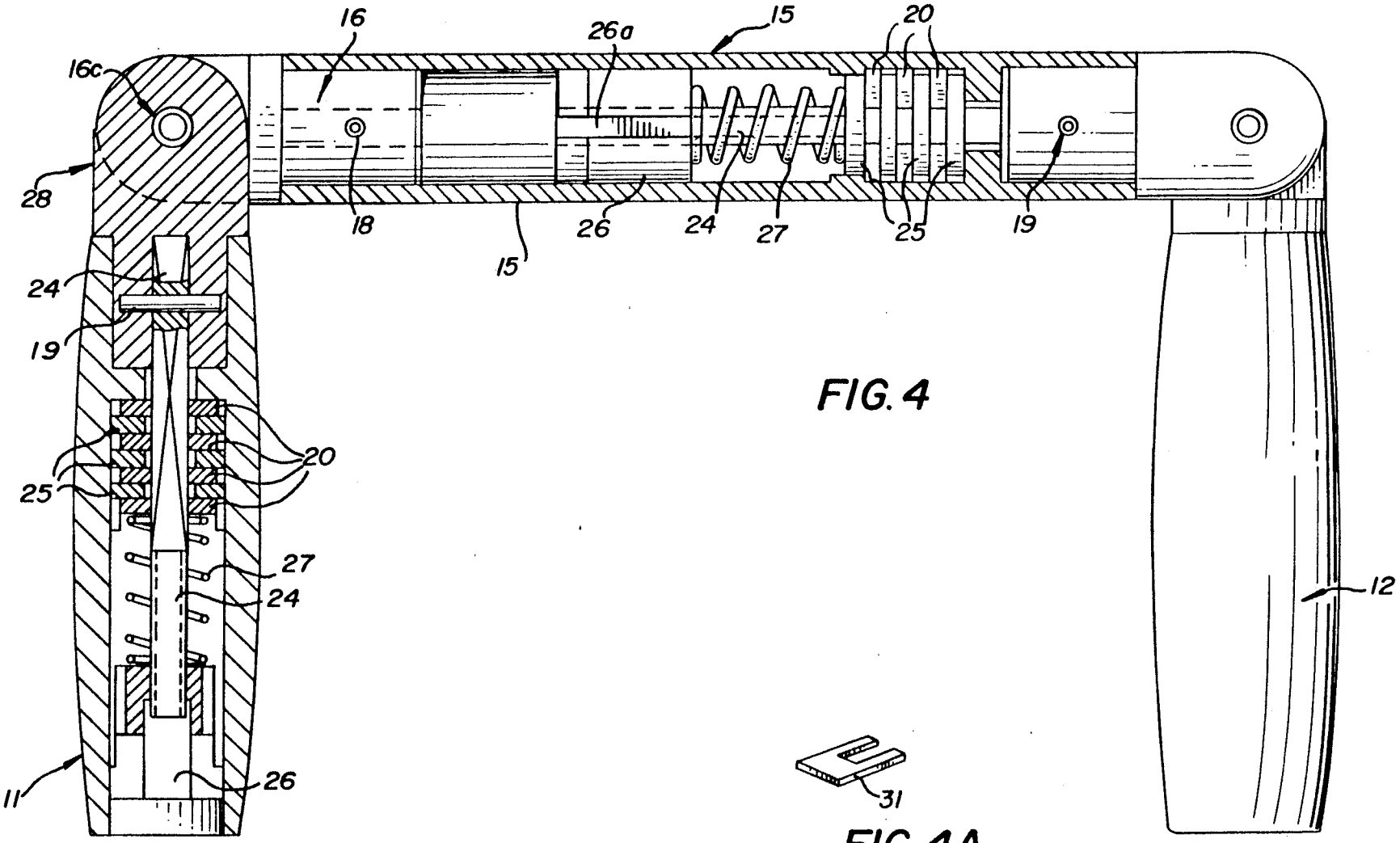
FIG. 4 is a side view of the exerciser of FIG. 1 partly in section to reveal the internal components of the cross-bar and one of the handles.
FIG. 4A is a perspective representation of a key which is suitable for adjusting torque and force characteristics of the exerciser.

As shown in FIGS. 2 and 4, the cross-bar 13 is formed of a tubular housing 15 which has open ends 15*a* and 15*b*. The open ends 15*a* and 15*b* provide sockets for clevises 16 and 17. Clevis 17 has a hole 17*c* extending through it which receives an expansion pin 17*d*. The expansion pin 17*d* also extends through a hole 28*a* in a rod eye 28 mounted on one end of handle 12 (FIG. 3) to pivotally couple the handle to the cross-bar.

Tubular housing 15 further accommodates and positions three static friction disks 20 by means of four axially extending keys 21 formed on the inner wall of the tubular housing. The tubular housing also defines a retainer wall 22 at the bottom of the socket which receives clevis 17, and a bore 23 is formed in the retainer wall for receiving the forward end 24*a* of a tension rod 24. The tension rod extends coaxially through the friction disks 20 and also through a number of static friction disks 25 which are interposed between the friction disks 20. The static friction disks 25 have squared central holes 25*a* which receives the forward end 24*a* of tension rod 24. The forward end 24*a* of tension rod 24, likewise, has a square cross section so that the disks 25 are effectively keyed to the tension rod. The disks 20, on the other hand, have round central holes, and they are rotatably supported on the friction rod.

The disks 25 and 20 are spring loaded by a spring 27. The rear end 24*b* of tension rod 24 is threaded for receiving a barrel nut 26. An expansion pin 19 extends through a hole 17*d* in clevis 17 and through a hole 24*c* in the forward end 24*a* of a tension rod 24. An expansion pin 18 extends through a hole 18*a* in housing 15 of the cross-bar 13, and also through a hole 16*b* in clevis 16.

To assemble the cross-bar exerciser to its assembled state shown in FIG. 4, the square end 24*a* of the tension rod 24 is inserted to a square sockets 17*a* in the rear end of clevis 17, and the rod is secured in place by inserting extension pin 19 through holes 17*b* in the clevis and through hole 24*c* in the forward end of rod. The clevis is then moved against the end of 15*b* of housing. Friction discs 20 25 are then inserted through the end 15*a* of the housing, followed by spring 27, all coaxial with the tension rod 24, and the components are tightened in place by threading barrel nut 26 to the threaded end 24*b* of the tension rod. The clevis 16 is then inserted into the end 15*a* of the cross-bar housing 15, and is held in place by expansion pin 18. The inner end of clevis 16 is spaced from barrel nut 26, as shown in FIG. 4.

The barrel nut 26 causes spring 27 to exert a force on friction discs 20 and 25. Then, as the handles 11 and 12 are turned relative to one another about the axis X—X of cross-bar 13, the user experiences a torque which must be overcome, because this action causes the disks 25 to rotate with respect to disks 20. The torsion may be adjusted by turning the barrel nut 26 about the threaded end 24*b* of rod 24. This may be accomplished by inserting a key 31 (FIG. 4A) through a slot 30 in the cross-bar housing (FIG. 1) to engage longitudinal slots 26*a* in the barrel nut 26.

An examination of FIGS. 3 and 4 will reveal that the internal components of the handles 11 & 12 may be identical to the internal components of the cross-bar 13, and the components of the handles are identified by the same numerals as the corresponding components in the cross-bar. This construction simplifies the manufacture of the exerciser of the invention.

Figure 5:
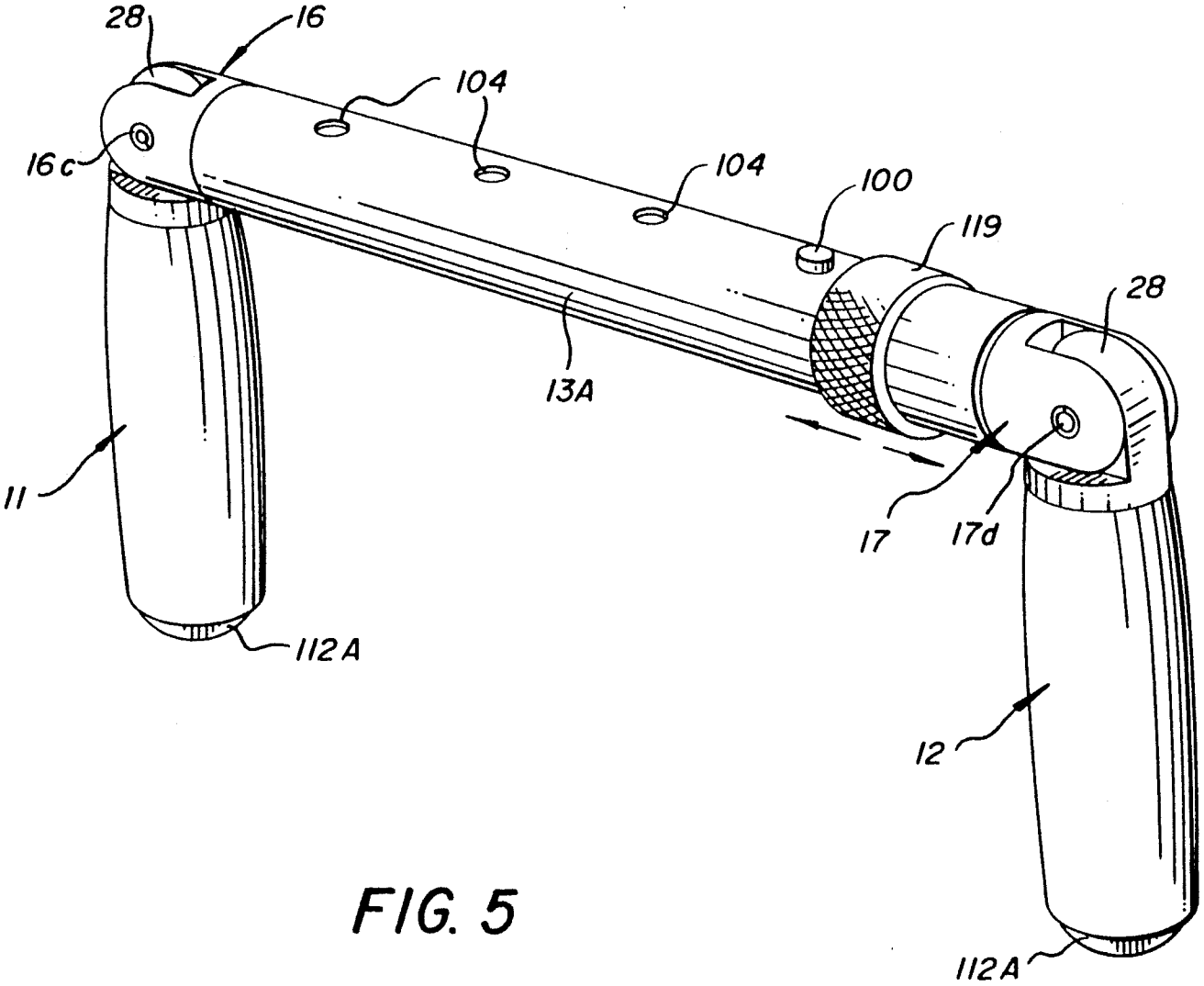
FIG. 5 is a perspective view of an exerciser representing a second embodiment of the invention.
Figure 6:
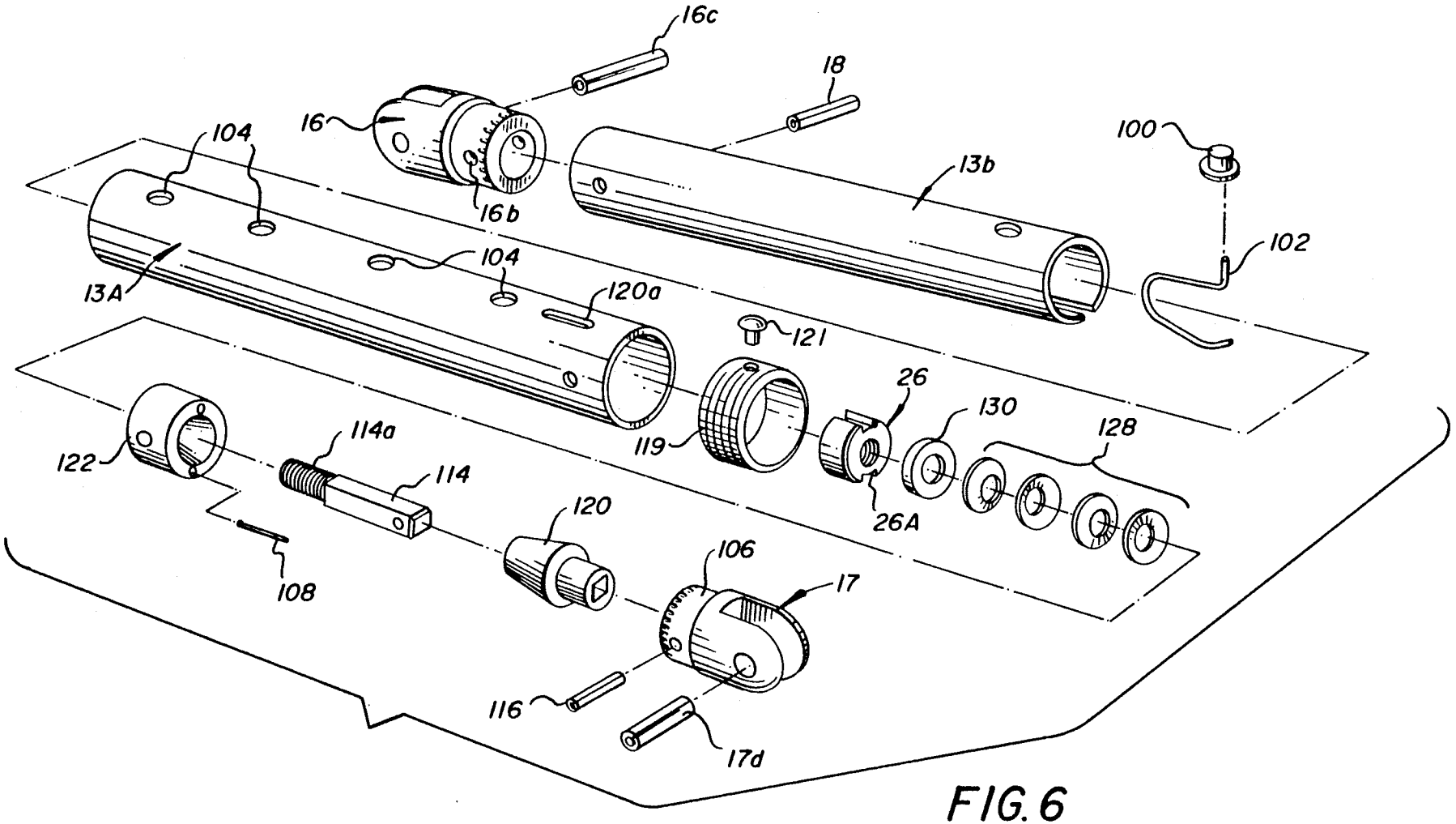
FIG. 6 is an exploded perspective view of a cross-bar assembly representing one of the components of the exerciser of FIG. 5, and also showing the internal components of the cross-bar assembly.
Figure 7:
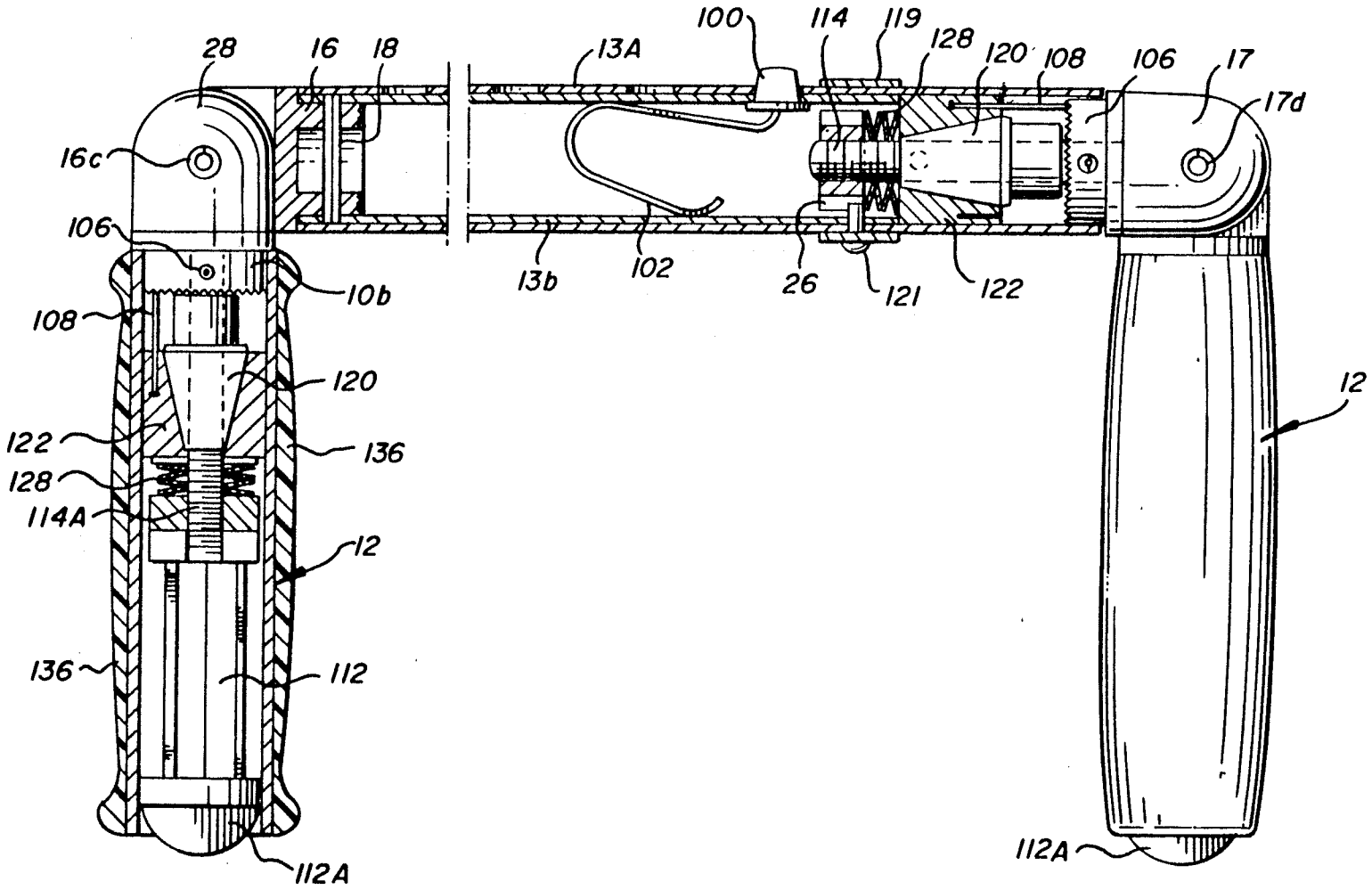
FIG. 7 is a side view of the exerciser of FIG. 5, partly in section to reveal the internal components of the cross-bar and one of the handles.
Figure 11:
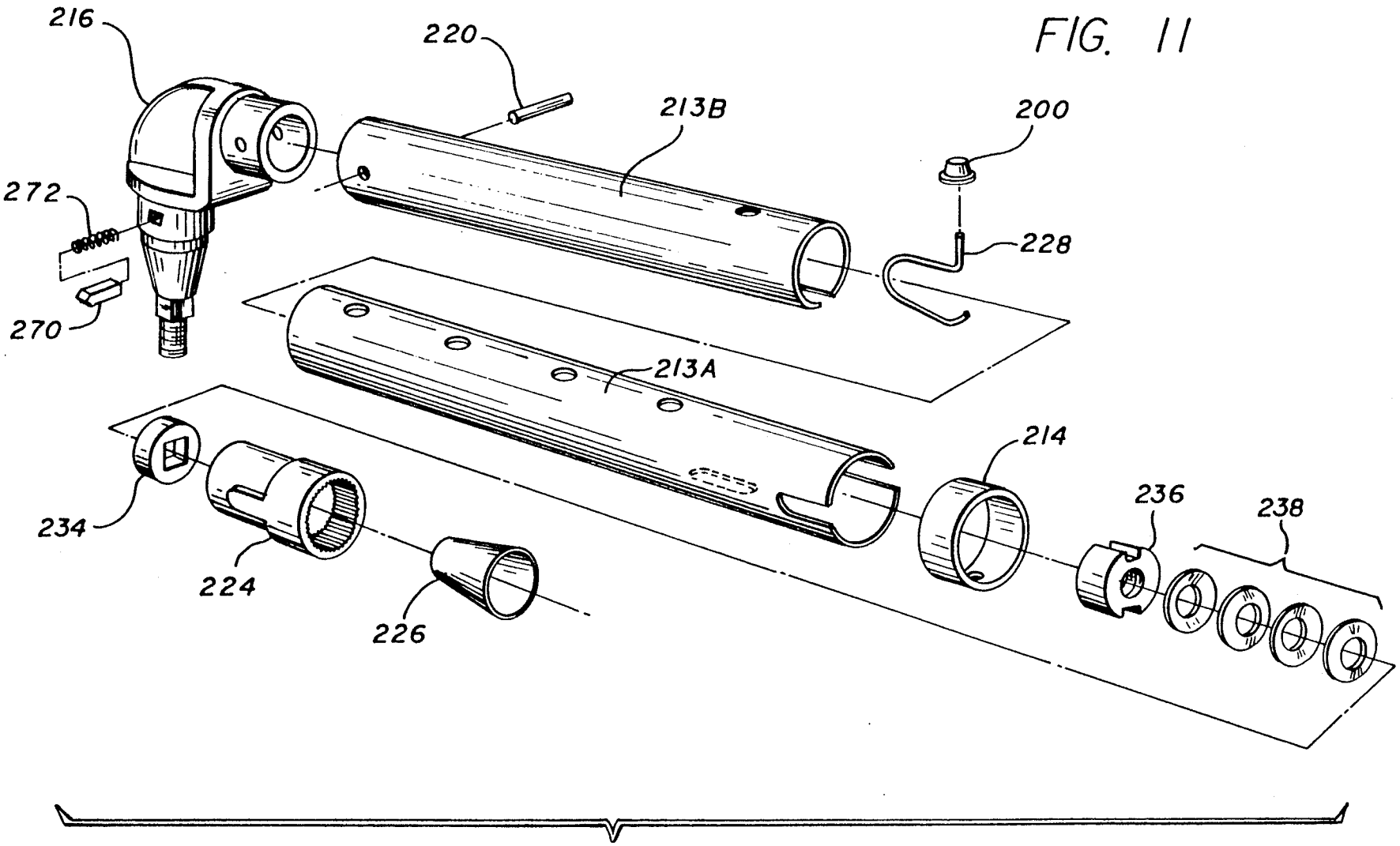
FIG. 11 is an exploded perspective view of the cross-bar assembly representing one of the components of the exerciser of FIG. 8.
Figure 12:
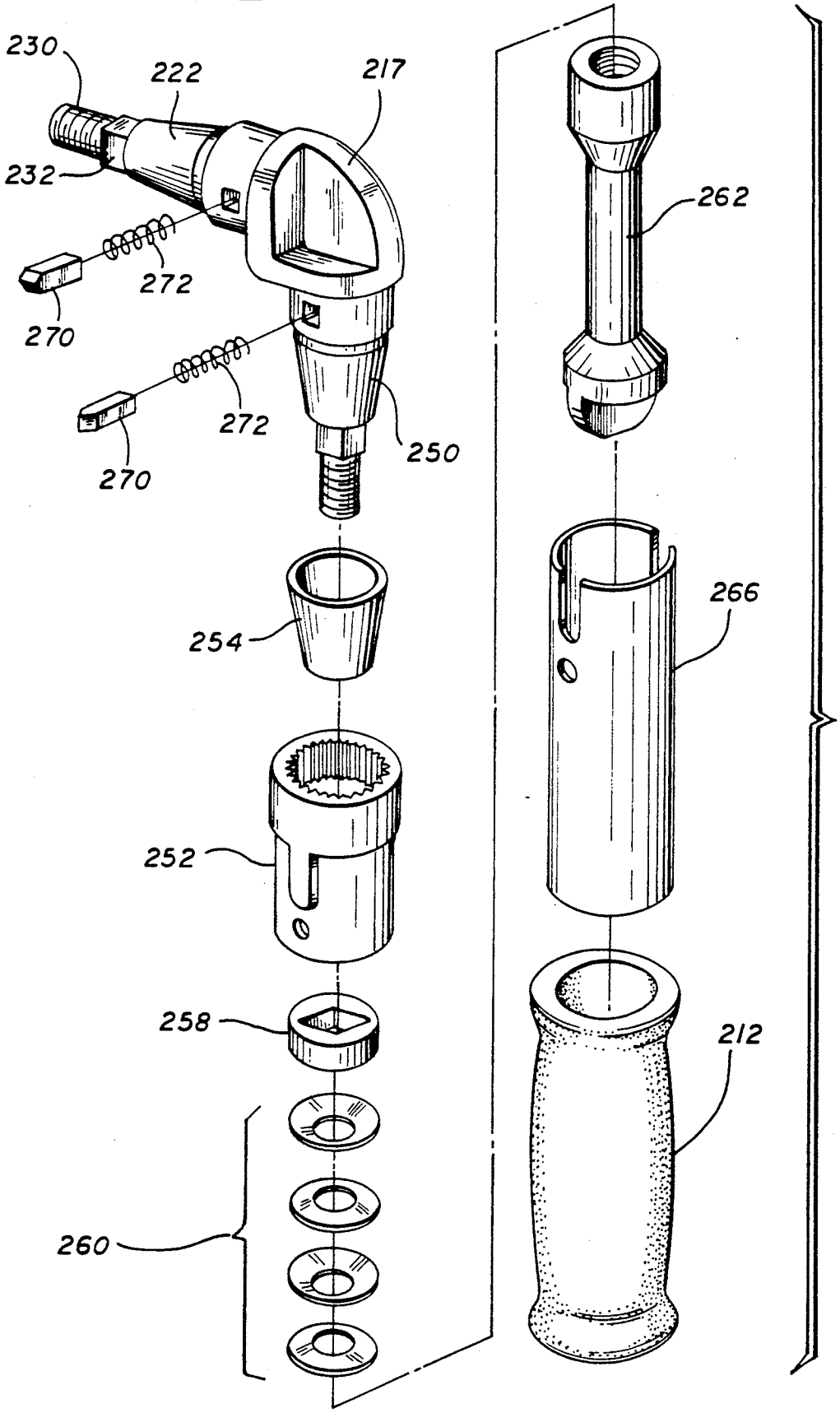
FIG. 12 is an exploded perspective view of one of the internal components of one of the handles of the exerciser of FIG. 8.

In the embodiment of FIGS. 5–7, elements similar to the elements of the previous embodiment have been designated by the same numbers. The embodiment of FIG. 5–7 includes a cross-bar 13A which is extensible, for example, between 12" and 20". For that purpose, the cross-bar is formed of two coaxial sleeves 13A and 13B, with sleeve 13B being telescopically received in sleeve 13A. The sleeves can be set in any desired extension by depressing a push-button 100 inwardly against the force of a spring 102, and sliding the inner sleeve 13B along the outer sleeve 13A until the push-button is received by selected one of a series of holes 104 formed in the outer sleeve.

The clevis 16 is staked into one end of the inner sleeve 13B by pin 18, as in the previous embodiment. Clevis 17, on the other hand, is attached to a notched disc !06 which is engaged by a pin 108 to present a clicking noise as the handles are turned about the longitudinal axis of the cross-bar. Clevis 17 and notched disc 106 are attached to a shaft 114, and a conical member 120 is fitted to the shaft in coaxial relationship therewith, the conical member being secured to the shaft to rotate when the shaft is rotated. The inner end of the shaft 114 is threaded by threads 114*a*.

The shaft 114 extends through a socket 122 which is secured to the inner sleeve 13*a* by screws 126 and 128. The threaded end of shaft 114 extends through the socket 112, and through a number of resilient washers 128, the washers being cup-shaped shaped to form a spring when they are compressed together.

The threaded end of the shaft 114 then extends through a washer 130 into the barrel nut 26. The barrel nut 26 is threaded onto the shaft 114 drawing it into the socket 122, with the conical outer surface of the member 120 engaging a mating conical inner surface of the socket 122 in frictional engagement. As the barrel nut 26 is tightened on the threaded end 114*a* of shaft 114, the washers 128 are compressed, so as to cause a frictional resistance between the conical member 120 and the inner surface of socket 122. This frictional resistance may be adjusted by tightening or loosening the barrel nut 26 to the threaded end 114*a* of shaft 114, this being achieved by turning a ring 119 which is equipped with a radial pin which engages the barrel nut.

As shown in FIG. 7, a similar mechanism may be used within each of the handles 12, and the internal components are similarly numbered.

The exerciser of the second embodiment may be assembled in a manner similar to the first embodiment, and it operates in essentially the same manner. The second embodiment has a feature, as described above, of being extensible; and it also has the feature of emitting clicking noises as the handles are turned about the longitudinal axis of the crossbar, and as each of the handles is turned about its own longitudinal axis.

The exerciser of embodiment FIGS. 8–12 is generally similar to that of FIGS. 5–7, and it operates in substantially the same manner. As shown in FIG. 8, the embodiment includes an outer tube 213A which, together with an inner tube 213B (FIG. 11), form the cross-bar, with the inner tube being telescopically received in the outer tube. The cross-bar may be set at adjustable lengths by depressing snap button 200.

A first handle is attached to one end of the cross-bar by means of a double torque cone assembly 217, the first handle having a sponge rubber handle grip 212; and a second handle is attached to the other end of the cross-bar by means of a torque cone assembly 216, the second handle having a foam rubber handle grip 211. As in the previous embodiments, the two handles may be turned in opposite directions about the longitudinal axis of the cross-bar, and each handle may be turned about its own longitudinal axis. The left-hand handle is pinned to the outer tube 213A by means of a pin 220, so that when the left-hand handle is turned about the longitudinal axis of the cross-bar, tubes 213A and 213B are caused to rotate.

As shown in FIG. 9, the double torque cone assembly 217 includes a first cone 222 which extends into a cone socket 224 mounted at one end of the tubes 213A and 213B. A floating cone bushing 226 is interposed between cone 222 and the cone socket 224. As also shown in FIG. 9, snap button 200 extends between aligned holes in the inner and outer tubes 213B and 213A, and is held in its protruding position by a spring 228.

The cone assembly 217 has a shaft portion 230 which extends beyond cone 222, the shaft having a rectangular section 232 which extends through an anti-rotation washer 234. A barrel nut 236 is threaded to the end of shaft 230, and compresses a Belleville disc spring 238.

When the right-hand handle is turned about the longitudinal axis of the cross-bar, the cone 222 is caused to rotate within the cone socket 224, with cone bushing 226 opposing such rotation because of its frictional contact with the cone 222 and with the cone socket 224. The frictional force is controlled by adjusting nut 236. Nut 236 may be adjusted by turning ring 214, after the outer tube 213 has been moved into the inner tube 213 until a pin 240, which extends through ring 214, is aligned with one of the longitudinal slots in the barrel nut 236.

The double torque cone assembly 217 has a second cone 250 which extends into a cone socket 252, and which is separated from the socket by a cone bushing 254. A shaft 256 extends downwardly from the end of cone 250 through an anti-rotation washer 258 and through a Belleville spring 260. A nut 262 is threaded to the end of the shaft. The nut has an adjusting end 264 which extends through the end of the handle, and which permits the user to turn the nut so as to adjust the frictional force between cone 250 and cone socket 252 through bushing 254 within the handle. The handle is formed by a tubular grip 266 which is attached to the cone socket 252, and which is covered by the foam rubber handle grip 212.

As shown in FIG. 10, the cone socket 252 has a serrated inner perimeter, and the serrations are engaged by a pall 270 which is biased against the serrations by a compressing spring 272 to produce a clicking noise when the handle is turned about its horizontal axis. A similar assembly is included in the right-hand end of the cross-bar, so that a clicking noise is also produced when the handles are turned about the longitudinal axis of the cross-bar.

Figure 14:
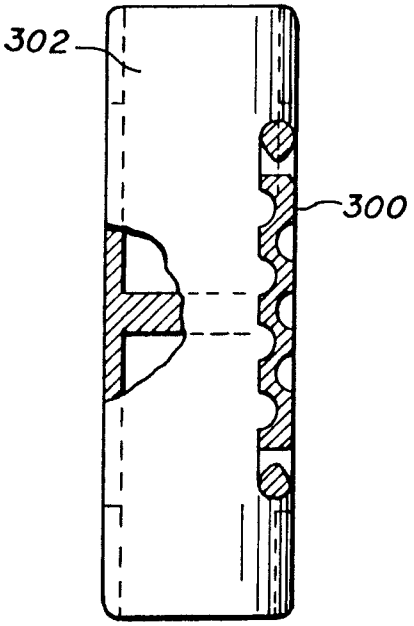
FIG. 14 is a section taken along the line 14—14 of FIG. 13.
Figure 13:
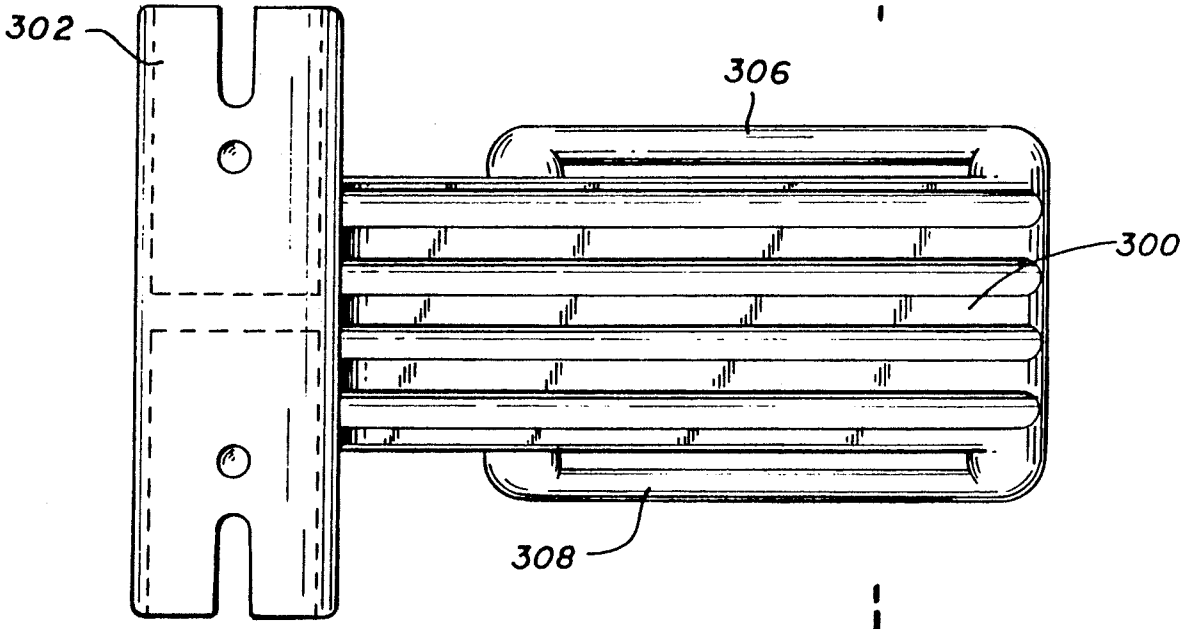
FIG. 13 is a plan view of an attachment to the exerciser to attach pedals to the exerciser to render it foot-operated.
Figure 15:
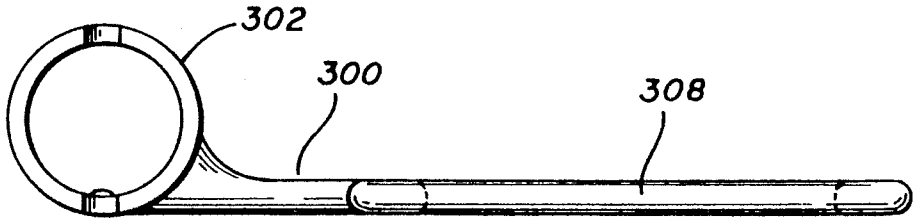
FIG. 15 is a side elevation of the assembly of FIG. 13.

In the embodiment of FIGS. 13–15, the handles of the exerciser are each replaced by a pedal 300 which is secured to a tubular member 302 which replaces handle grip tube 266 of FIG. 10 and the handle grip 212. The pedal has brackets 304 and 306 provided along each side to form slots for receiving appropriate straps to hold the feet in place. When the pedal assembly is attached to each end of the exerciser, the exerciser may be operated by the feet, instead of by the hands of the user. Also, the pedal may serve as an arm brace if so desired.

The invention provides, therefore, a simple hand-held or foot-operated exerciser which has adjustable torque characteristic, and which permits the user to turn a pair of handles around three distinct axes to perform any desired set of exercises.

It will be appreciated that while particular embodiments of the invention have been shown and described, modifications may be made. It is intended in the claims to cover all modifications which come within the true spirit and scope of the invention.

I claim:

1. An articulated exerciser comprising: a tubular elongated cross-bar assembly, and a pair of elongated assemblies mounted on opposite ends of said cross-bar assembly for rotation about the longitudinal axis of said cross-bar assembly and for further rotation about respective pivotal axes at the respective ends of said cross-bar assembly; said cross-bar assembly comprising: a tubular housing; a tension rod coaxially mounted within said housing and extending longitudinally thereof; at least one friction member coaxially mounted on said tension rod to be rotated by said tension rod; at least one further friction member coaxially and rotatably mounted on said tension rod; means for attaching said further friction member to said tubular housing; spring means coaxially mounted on said rod; a nut threaded to said rod and engaging said spring means for biasing said spring means in the direction of the friction members to cause the friction members to exert a friction force therebetween; means coupling one said elongated assemblies to said rod; and means coupling the other of said elongated assemblies to said tubular housing; so that relative rotation of said elongated assemblies of opposite directions causes the friction members to rotate in opposite directions against the friction force therebetween.

2. The exerciser defined in claim 1, and which includes a first plurality of friction discs coaxially mounted on said tension rod to be rotated thereby, and a second plurality of said further friction discs coaxially and rotatably mounted on said tension rod interposed between the discs of said first plurality, the further discs being attached to said tubular housing by said attaching means.

3. The exerciser defined in claim 1, in which said nut has slots formed therein to enable the nut to be adjusted along said rod to control the friction force between the friction members.

4. The exerciser defined in claim 1, in at least one of said handle assemblies is rotatable about its longitudinal axis.

5. The exerciser defined in claim 4, in which said one of said elongated assemblies includes: a tubular housing; a tension rod coaxially mounted with respect to said tubular housing and extending longitudinal within said tubular housing; at least one friction member coaxially mounted on said tension rod to be rotated by said tension rod; at least one further friction member coaxially and rotatably mounted on said tension rod; means attaching a further friction member to said tubular housing; spring means mounted on said rod; a nut threaded to said rod and engaging said spring means for biasing said spring means in the direction of said friction members to cause the friction members to exert a friction force therebetween.

6. The exerciser defined in claim 5, in which includes a first plurality of friction discs coaxially mounted on said tension rod to be rotated thereby, and a second plurality of further friction discs coaxially and rotatably mounted on said tension rod interposed between the discs of said first plurality and attached to said tubular housing by said attaching means.

7. The exerciser defined in claim 5, in which said nut has means formed thereon to enable said nut to be adjusted along said rod to control the friction force between the friction members.

8. The exerciser defined in claim 1, in which said elongated assemblies are shaped to simulate the handle of a particular sports equipment.

9. The exerciser defined in claim 1, in which the first-named friction member has a conical surface, and the further friction member comprises a socket with an internal conical surface for receiving the first friction member.

10. The exerciser defined in claim 9 and which includes a conical bushing interposed between the conical surfaces of said first-named friction member and of said further friction member.

11. The exerciser defined in claim 1, and which comprises a second tubular housing coaxially mounted over said first named tubular housing in telescopic relationship therewith, and in which one of said elongated assemblies is mounted to the end of one of said tubular housings; and the other of said elongated assemblies is mounted to the end of the other of said tubular housings to permit the cross-bar of the exerciser to be extended to selected lengths, and which includes manually adjustable means for setting the tubular housings in desired telescopic relationship with one another.

12. The exerciser defined in claim 1, and which includes a member mounted coaxially with said shaft to be rotated by one of said elongated assemblies, said last-named member having an annular ratchet configuration, and a further member supported within said tubular housing for engaging said ratchet to produce a clicking noise as the elongated members are rotated about the longitudinal axis of the cross-bar.

13. The exerciser defined in claim 5, and which includes a member mounted in said elongated assembly attached to said tension rod and having an annular ratchet and a striker member mounted in the tubular housing of said elongated assembly for engaging the ratchet to provide a clicking noise as the handle is rotated about its longitudinal axis.

14. The exerciser defined in claim 1 and which includes a pair of pedal members respectively attached to said elongated assemblies to enable the exerciser to be operated by the feet of a user.

* * * * *